US010488055B2

(12) United States Patent
Bruin-Slot et al.

(10) Patent No.: US 10,488,055 B2
(45) Date of Patent: Nov. 26, 2019

(54) CAVITY CONNECTOR

(71) Applicant: WHIRLPOOL CORPORATION, Benton Harbor, MI (US)

(72) Inventors: Zachary J. Bruin-Slot, Baroda, MI (US); Robert Scott Donarski, Stevensville, MI (US); Darrin H. McGee, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 379 days.

(21) Appl. No.: 15/394,896

(22) Filed: Dec. 30, 2016

(65) Prior Publication Data

US 2018/0187902 A1 Jul. 5, 2018

(51) Int. Cl.
*F24C 15/16* (2006.01)
*F24C 1/04* (2006.01)
*F24C 15/18* (2006.01)

(52) U.S. Cl.
CPC ..... *F24C 15/166* (2013.01); *F24C 1/04* (2013.01); *F24C 15/18* (2013.01)

(58) Field of Classification Search
CPC ..... F24C 15/166; F24C 1/04; F24C 15/18
USPC ..... 219/386, 391, 392, 396, 397, 398, 399, 219/400, 402, 403, 411, 413, 414, 552
See application file for complete search history.

(56) References Cited

U.S. PATENT DOCUMENTS

| | | | | |
|---|---|---|---|---|
| 2,142,381 | A | 1/1939 | Sickinger | |
| 2,683,795 | A | 7/1954 | Sheidler et al. | |
| 3,548,154 | A | 12/1970 | Christiansson | |
| 4,780,597 | A | 10/1988 | Linhart et al. | |
| 6,891,133 | B2 | 5/2005 | Shozo et al. | |
| 7,781,702 | B2 | 8/2010 | Nam et al. | |
| 8,327,837 | B2 | 12/2012 | Nam et al. | |
| 2007/0251936 | A1* | 11/2007 | Nam | F24C 15/166 219/413 |

* cited by examiner

*Primary Examiner* — Phuong T Nguyen
(74) *Attorney, Agent, or Firm* — Price Heneveld LLP

(57) ABSTRACT

A cooking appliance is provided herein that includes a pair of opposing sidewalls and a rear wall defining a heating cavity. A heat source is in thermal communication with the heating cavity. A cavity connector is disposed within an interior surface of the heating cavity. The cavity connector is in communication with the heating cavity. A rack is coupled with a sliding structure. The sliding structure is disposed proximate the pair of sidewalls. A powered accessory has a connecting plug and is engageable with the rack. The connecting plug is configured to be in selective communication with the cavity connector. A first locating assembly is configured to locate and engage the powered accessory with the rack. A second locating assembly is disposed between the sliding structure and the opposing sidewalls. A third locating assembly is disposed on a rear portion of the rack.

10 Claims, 19 Drawing Sheets

CAVITY CONNECTOR

BACKGROUND

Accessory racks may be connected to appliances through a connector disposed within the cooking cavity of the appliance. It is desired for the connector to be locatable within the cavity.

SUMMARY

In at least one aspect, a cooking appliance is disclosed. The cooking appliance includes a pair of opposing sidewalls and a rear wall defining a heating cavity. A heat source is in thermal communication with the heating cavity. A cavity connector is disposed within an interior surface of the heating cavity. The cavity connector is in communication with the heating cavity. A rack is coupled with a sliding structure. The sliding structure is disposed proximate the pair of sidewalls. A powered accessory has a connecting plug and is engageable with the rack. The connecting plug is configured to be in selective communication with the cavity connector. A first locating assembly is configured to locate and engage the powered accessory with the rack. A second locating assembly is disposed between the sliding structure and the opposing sidewalls. A third locating assembly is disposed on a rear portion of the rack.

In at least another aspect, a cooking appliance is disclosed. A pair of sidewalls and a rear wall define a heating cavity. A heat source is in thermal communication with the heating cavity. A cavity connector is disposed within an interior surface of the heating cavity. The cavity connector is in communication with the heating cavity. A rack is defined by a plurality of wires coupled to a frame. A powered accessory has a connecting plug and is engageable with the rack. The connecting plug is configured to be in selective communication with the cavity connector. A first locating assembly is configured to locate the powered accessory on the rack.

In at least another aspect, a powered accessory system for use in an appliance is disclosed. The powered accessory system includes a base pan that is configured to be selectively engaged with a rack within a cavity of said appliance. A first base structure is disposed on a bottom portion of the base pan. The first base structure defines a groove therein. A second base structure is disposed on the bottom portion of the base pan and is separated from the first base structure. A connecting plug is in communication with the said appliance. Selective engagement of the connecting plug with a cavity connector that is disposed within the cavity of said appliance places the powered accessory in communication with said appliance.

These and other features, advantages, and objects of the present device will be further understood and appreciated by those skilled in the art upon studying the following specification, claims, and appended drawings.

DETAILED DESCRIPTION OF EMBODIMENTS

Figure 1:
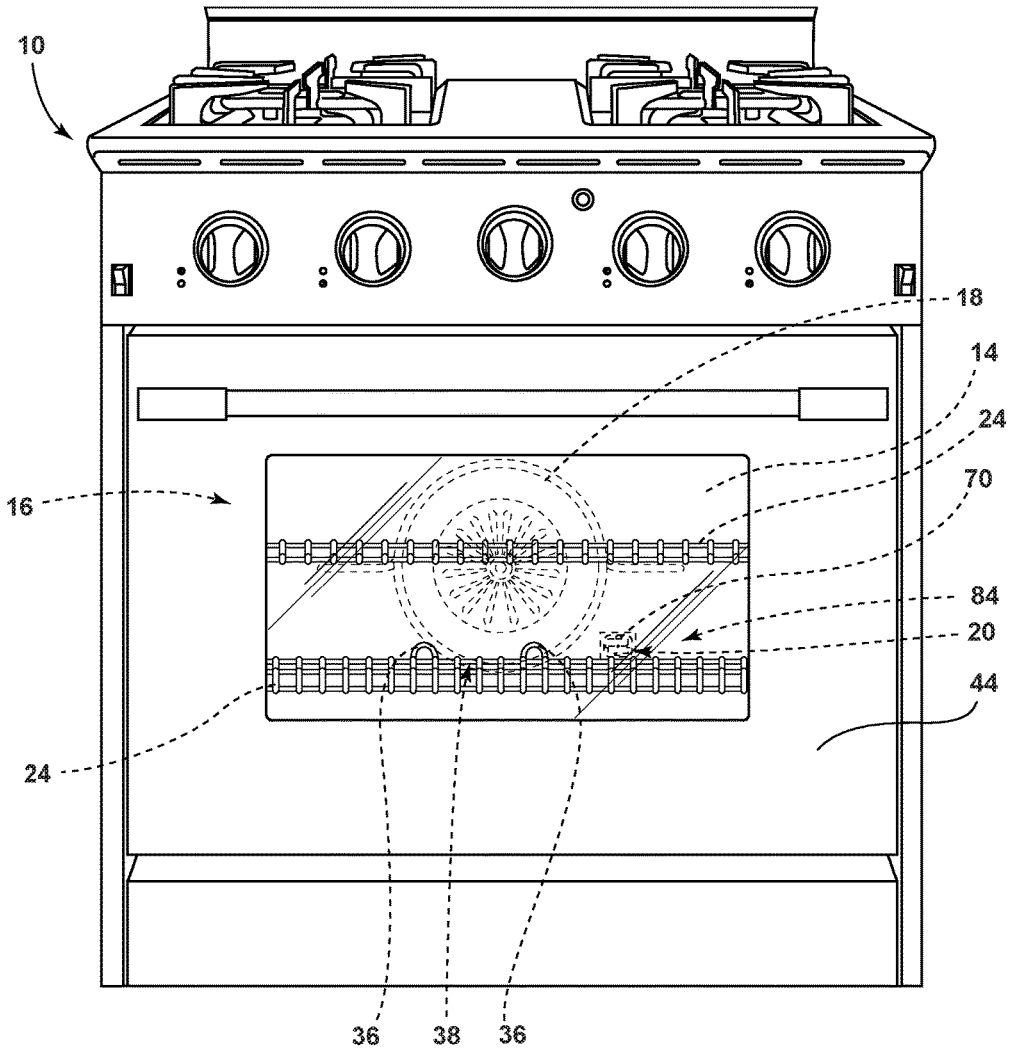
FIG. 1 is a front perspective view of the cooking appliance incorporating a cavity connector, according to one embodiment.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As required, detailed embodiments of the present invention are disclosed herein. However, it is to be understood that the disclosed embodiments are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIGS. 1-22, reference numeral 10 generally refers to a cooking appliance that includes a pair of opposing sidewalls 12 and a rear wall 14 defining a heating cavity 16. The heat source 18 is in thermal communication with the heating cavity 16. A cavity connector 20 is disposed within an interior surface 22 (e.g., the sidewalls 12 and/or the rear wall 14) of the heating cavity 16. The cavity connector 20 is in communication with the heating cavity 16. A rack 24 is coupled with a sliding structure 26. The sliding structure 26 is disposed proximate the opposing sidewalls 12. A powered accessory 28 has a connecting plug 30. The powered accessory 28 is engageable with the rack 24. The connecting plug 30 is configured to be in selective communication with the cavity connector 20. A first locating assembly 32 is configured to locate the powered accessory 28 on the rack 24. A second locating assembly 34 is disposed between the sliding structure 26 and the opposing sidewalls 12. A third locating assembly 36 is disposed on a rear portion 38 of the rack 24.

Referring to FIG. 1, according to the various embodiments, the cooking appliance 10 may be configured as an oven that includes the pair of sidewalls 12, the rear wall 14, and a door 44 to define the heating cavity 16. The heat source 18 is in thermal communication with the heating cavity 16. The heat source 18 can include, but is not limited to, gas heat, convection heating, electrically resistive elements, electrically inductive elements, radiant heating, combinations thereof, and/or other similar heat sources 18 for use within the heating cavity 16 of the cooking appliance 10.

Figure 2:
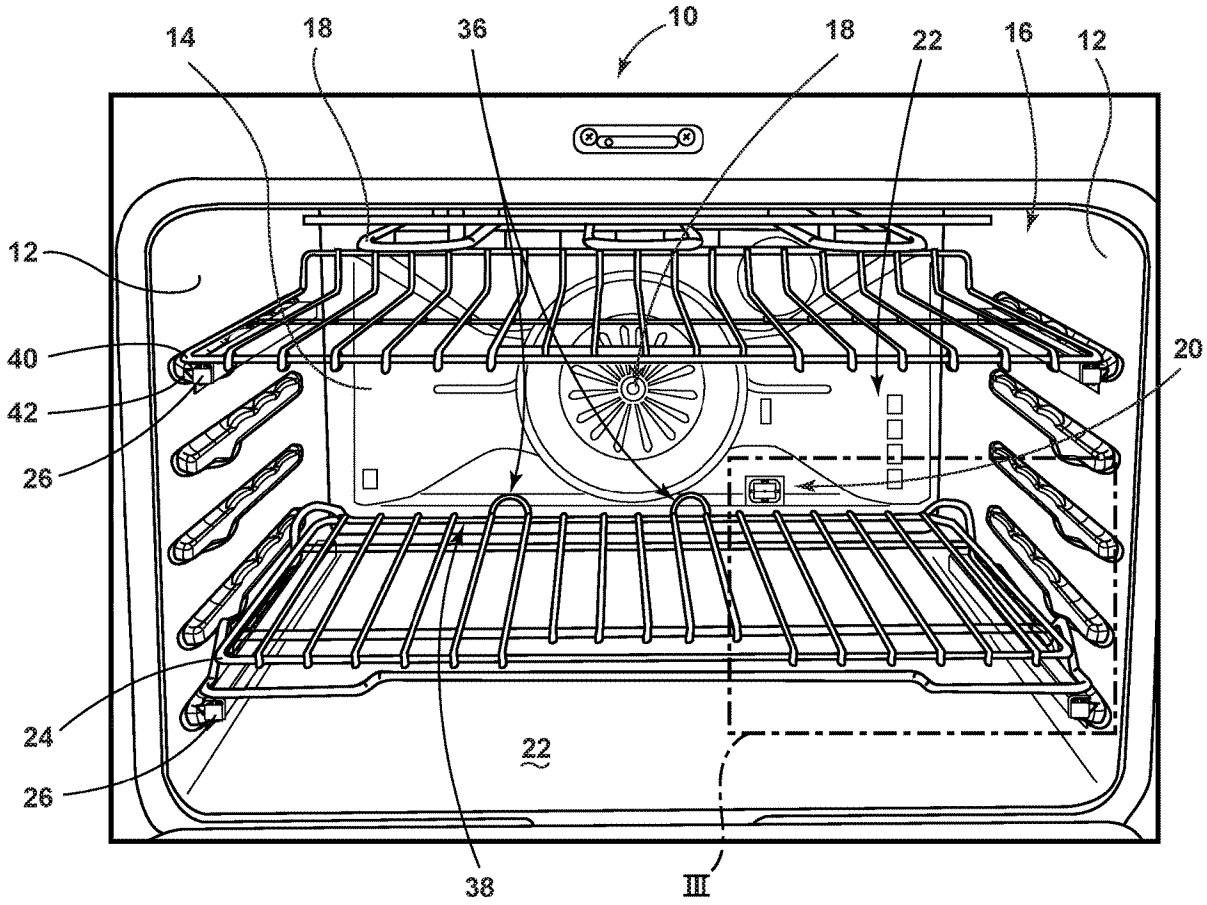
FIG. 2 is a front perspective view of the heating cavity of the cooking appliance of FIG. 1 with the appliance door in an open position.
Figure 3:
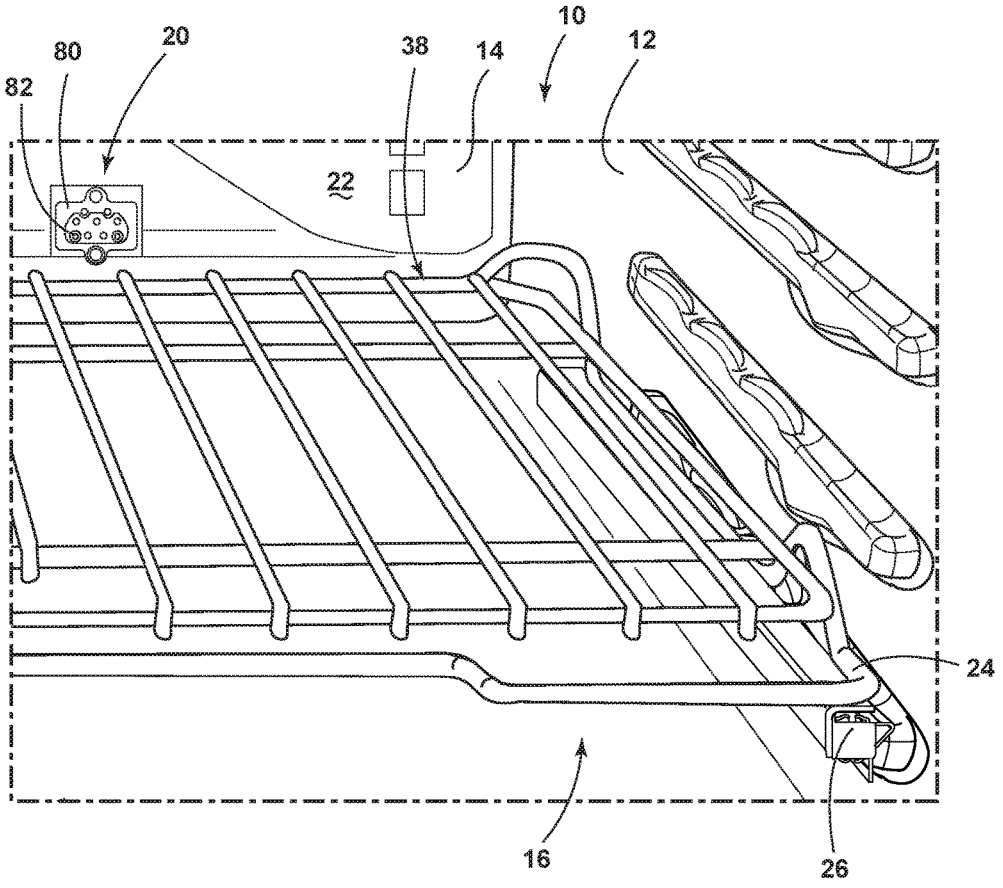
FIG. 3 is an enlarged perspective view of the oven cavity of FIG. 2 taken at area III.

Referring to FIGS. 2 and 3, the first rack 24 is disposed within the heating cavity 16 and is coupled with a first sliding structure 26 that is disposed proximate the opposing sidewalls 12. A second rack 40 may be vertically offset from the first rack 24 and may be coupled with a second rack sliding structure 42 that is disposed proximate the opposing sidewalls 12. The first and second rack sliding structures 26, 42 can take the form of oven rack glides, drawer glides, oven rack supporting protrusions, and other similar rack supporting structures that are removably coupled and/or securely fastened to the rack 24 and/or the opposing sidewalls 12.

The cavity connector 20 is disposed within the interior surface 22 of the heating cavity 16. The cavity connector 20 is in communication with the heating cavity 16. In this manner, the cavity connector 20 is accessible by the user within the heating cavity 16. For example, in various embodiments, the cavity connector 20 can be disposed within the rear wall 14 of the heating cavity 16. It is also contemplated that the heating cavity 16 can include a plurality of cavity connectors 20 disposed in various positions of the heating cavity 16 to be accessed when the powered accessory 28 is disposed in engagement with any one of the racks 24, 40. According to various embodiments, each rack 24, 40 can be positioned in conjunction with a separate and dedicated cavity connector 20 positioned for providing electrical power to the powered accessory 28 when the powered accessory 28 is disposed in a corresponding rack 24, 40.

The cavity connector 20 can be installed within the cooking appliance 10 either during or after manufacture. When installed after manufacture, it is contemplated that a spacer or plug 30 can be installed within the heating cavity 16 of the appliance 10. When the cavity connector 20 is installed, the spacer or plug 30 can be removed and the cavity connector 20 inserted to be engaged, attached, or otherwise placed in communication with the various electrical, communications, and/or user interface systems of the appliance 10.

Figure 4:
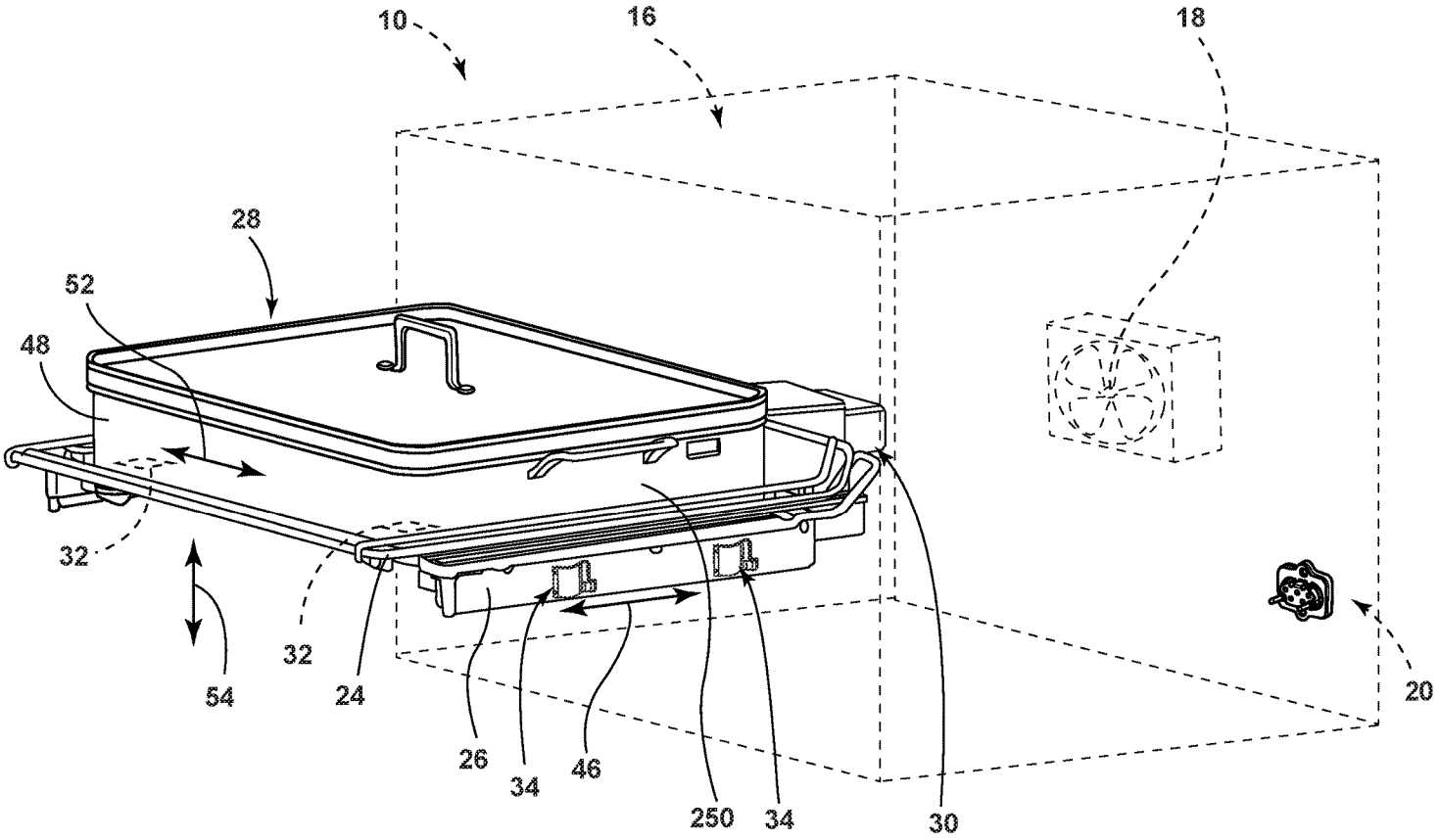
FIG. 4 is a side perspective view of a powered accessory used in conjunction with the cavity connector for a cooking appliance, according to various embodiments.

Referring to FIG. 4, the powered accessory 28 for use in the cooking appliance 10 includes the connecting plug 30. The powered accessory 28 is alternatively and selectively engaged with the first rack 24, although, the powered accessory 28 may be engaged with any one or more racks 24, 40 and in communication with any one or more cavity connectors 20. When engaged with the first rack 24, the sliding structures 26, 42 may move the rack 24 in the forward/rearward direction 46 (i.e., from a position away from the rear wall 14 to a position in close proximity to the rear wall 14 and vice versa). As the rack 24 is moved towards the rear wall 14, the connecting plug 30 is placed in selective communication with the cavity connector 20.

The powered accessory 28 can include a base pan 48 that may be disposed on and/or engageable with any of the racks 24, 40. The base pan 48 may include a resistive heating element that can be placed in selective communication with the cavity connector 20. In this manner, as the powered accessory 28 is engaged with one of the racks 24, 40, the engaged or connected powered accessory 28 can be placed in communication with the cooking appliance 10 via the cavity connector 20.

The base pan 48 for the powered accessory 28 can be used in conjunction with various accessory inserts. These accessory inserts can include, but are not limited to, a grilling insert, a cooking stone insert, a steaming insert, a smoker insert, a rotisserie insert, a canning insert, a pressure cooking insert, a slow cooker insert, an internal convection insert, sous-vide heater, a deep-frying insert, an air-frying insert, an air roaster insert, an air-crisper insert, a dedicated heating chamber insert, combinations thereof, and other similar inserts. It is contemplated that at least a portion of the accessory inserts can be used in combination with the resistive heating element.

According to the various embodiments, each of the accessory inserts can be used in conjunction with a dedicated powered accessory 28, such that each of the at least one powered accessory 28 can have a dedicated insert used only for that powered accessory 28 (i.e., each insert has a dedicated base pan 48, the specific insert has its own base pan 48, and/or the specific insert does not need a base pan 48). Alternatively, the plurality of powered accessories 28 can share common components, such as the base pan 48 that are interchangeable with respect to the insert being used.

The powered accessory 28 may include the one or more locating assemblies to assist in coupling the connection plug 30 to the connector as the accessory, disposed on the rack 24, is slid into the heating cavity 16. In various embodiments, the first locating assembly 32 is disposed on a bottom portion 50 (FIG. 13A) of the powered accessory 28 and is configured to align the powered accessory 28 on the rack 24 in a lateral direction 52 and/or in the forward/rearward direction 46. The second locating assembly 34 is configured to align the powered accessory 28, and consequently the connection plug 30, in the lateral direction 52. The sliding structure 26 and features disposed on the opposing sidewalls 12 of the heating cavity 16 may also vertically align the powered accessory 28 in a vertical direction 54. The third locating assembly 36 is disposed on the rack 24 and/or integrally formed thereon and may prevent movement towards the rear wall 14 beyond a predetermined position through contact between the third locating assembly 36 and the rear wall 14.

Figure 5:
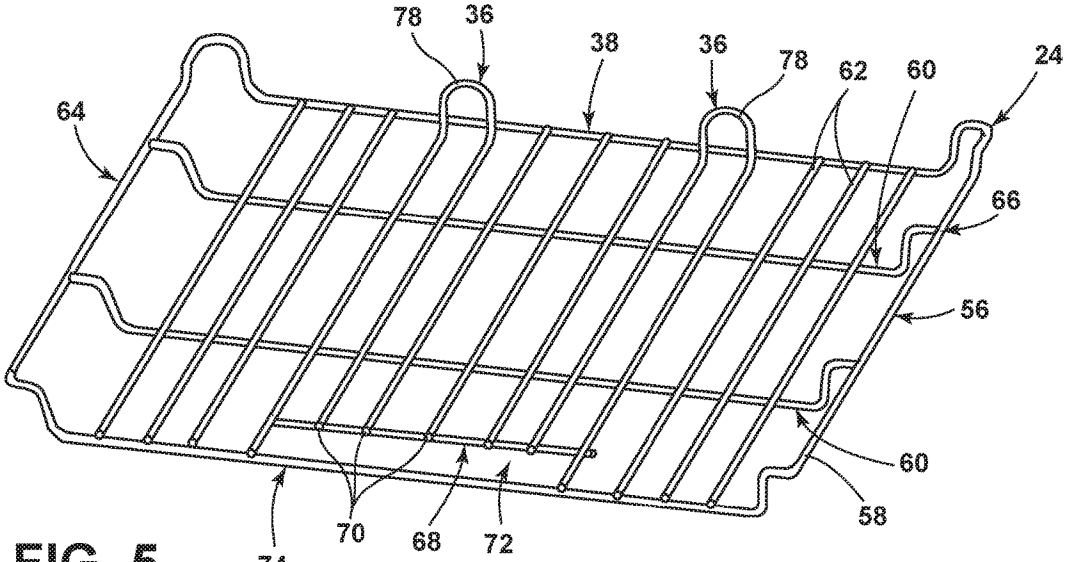
FIG. 5 is a top perspective view of a rack that is disposed within the heating cavity, according to one embodiment.
Figure 6:
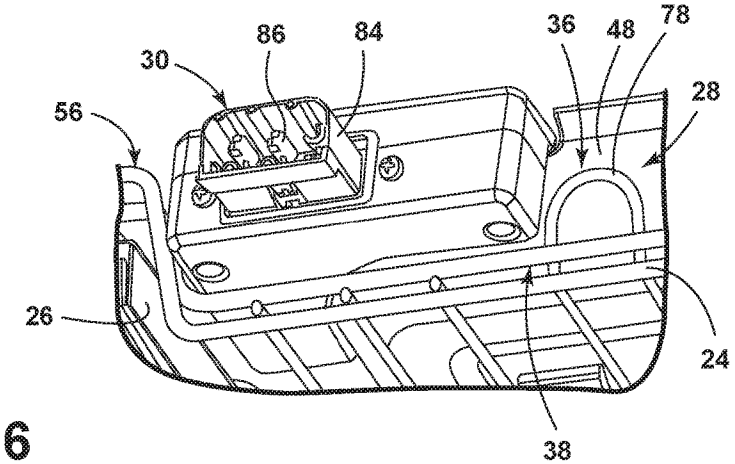
FIG. 6 is a rear bottom perspective view of the powered accessory connection plug, according to one embodiment.
Figure 8:
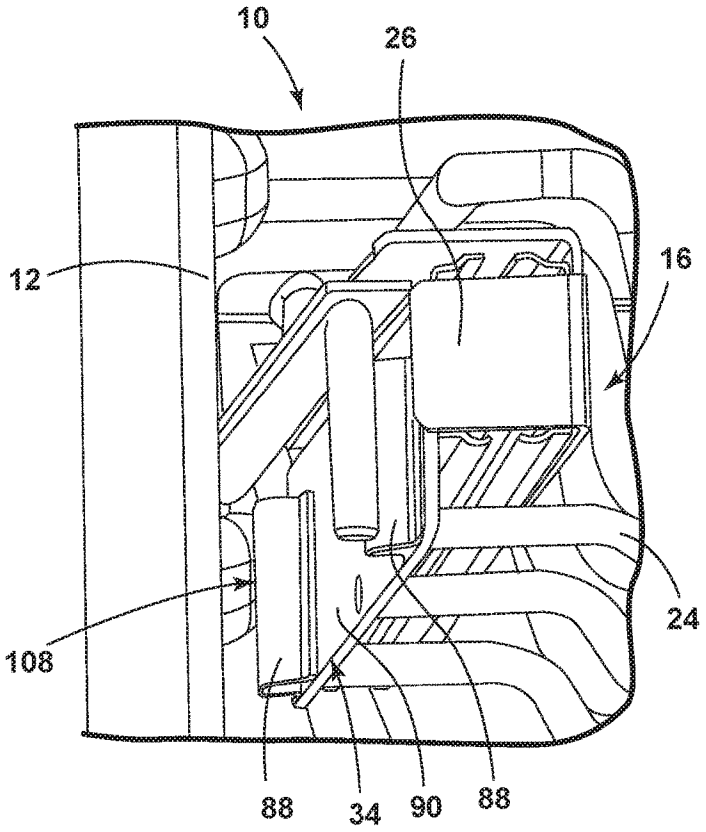
FIG. 8 is a bottom perspective view of the sliding structure and locating assembly of FIG. 7.
Figure 7:
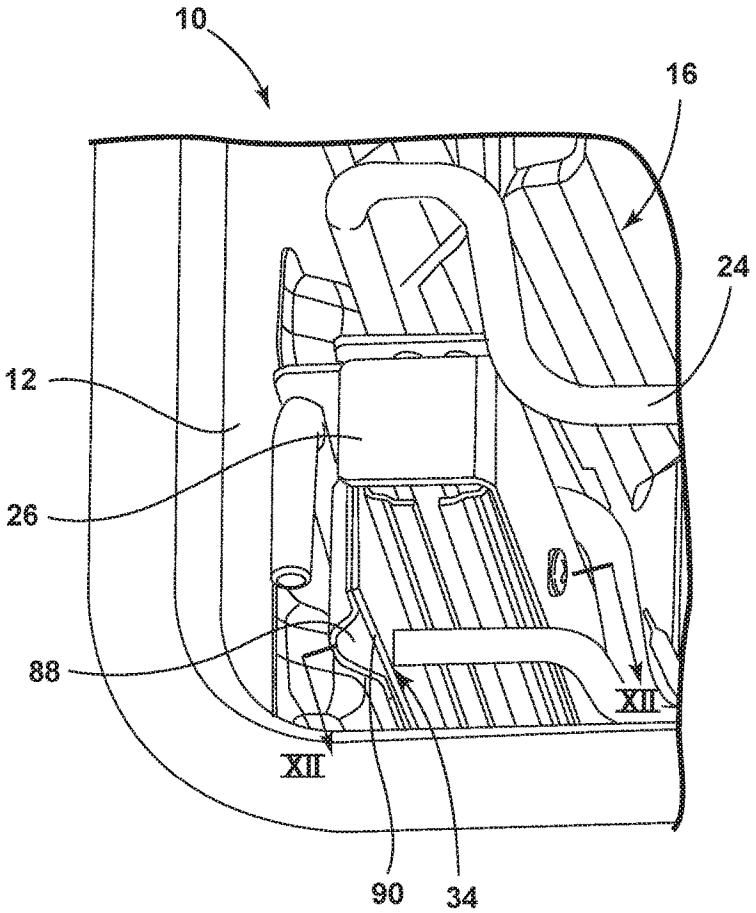
FIG. 7 is a bottom perspective view of a sliding structure that is removably coupled to the rack having a locating assembly coupled to the sliding structure, according to one embodiment.
Figure 9:
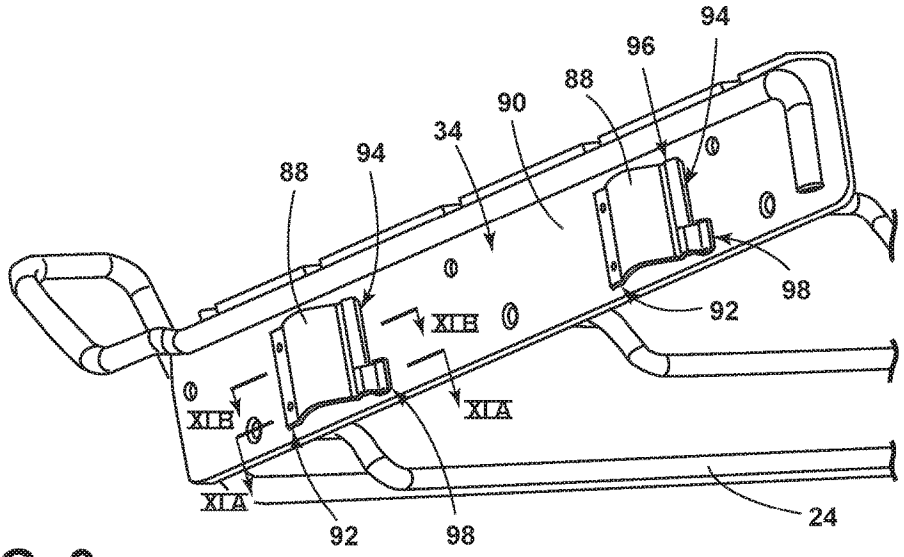
FIG. 9 is a side perspective view of the locating assembly of FIG. 7, according to one embodiment.
Figure 10:
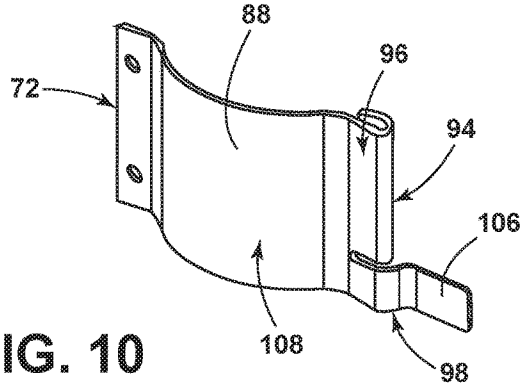
FIG. 10 is a side perspective view of a resilient component that is disposed within the locating assembly of FIG. 7, according to one embodiment.
Figure 11A:
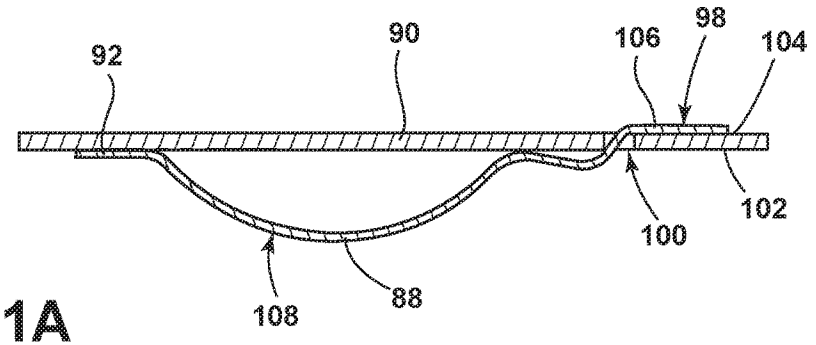
FIG. 11A is a cross-sectional view of the resilient component, according to one embodiment, taken along the line XIA-XIA of FIG. 9.
Figure 11B:
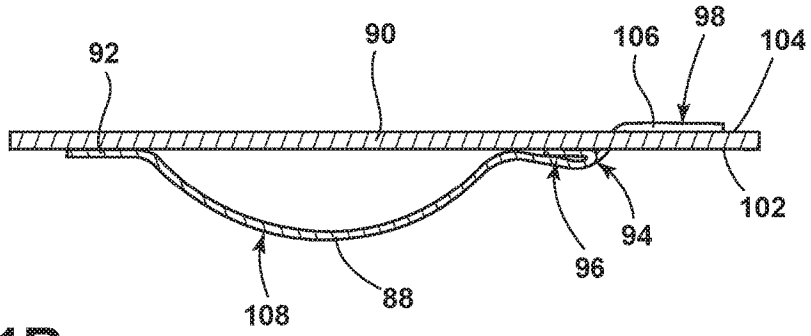
FIG. 11B is a cross-sectional view of the resilient component, according to one embodiment, taken along the line XIB-XIB of FIG. 9.
Figure 12:
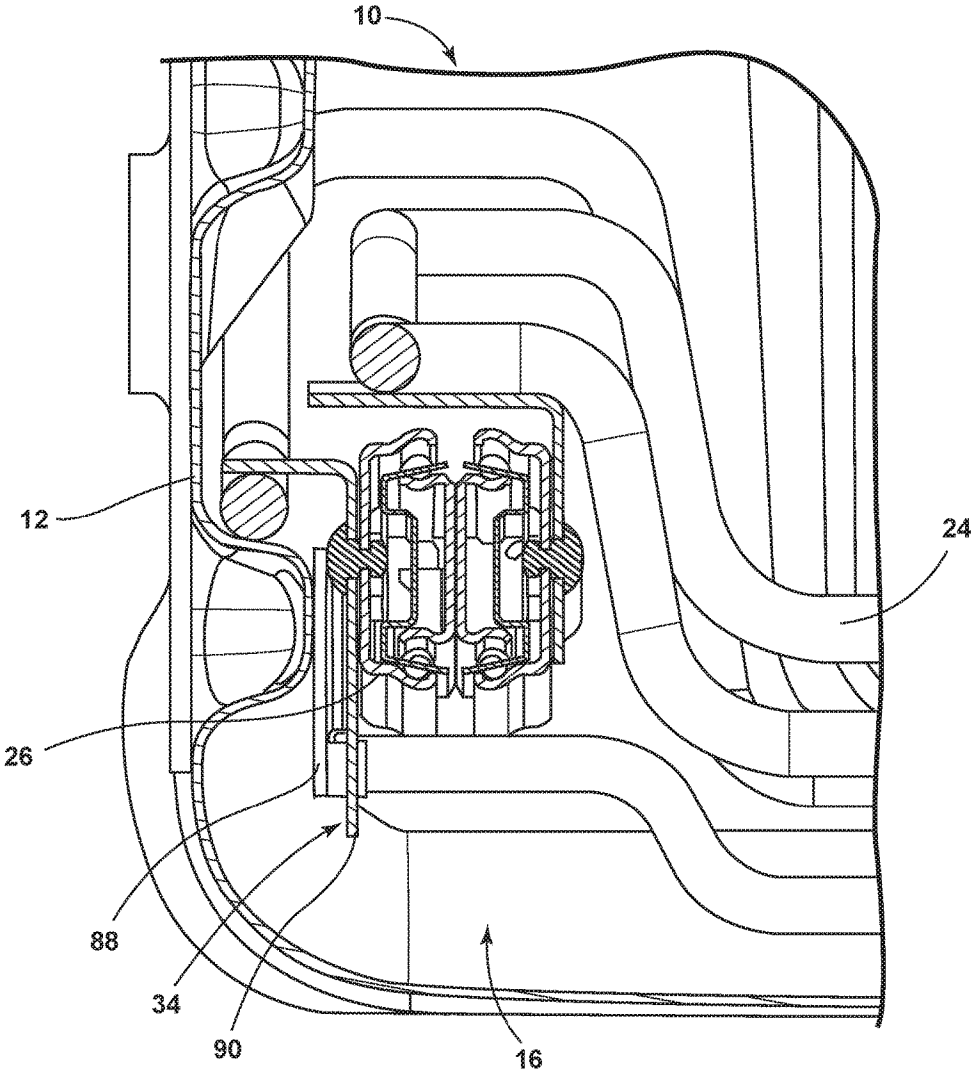
FIG. 12 is a cross-sectional view of the sliding structure, according to one embodiment, taken along the line XII-XII of FIG. 7.

Referring to FIGS. 5 and 6, the rack 24 has an outside frame 56, which may be formed from one or more frame wires 58, frame support wires 60, and a series of upper surface wires 62, which generally run rearwardly to forwardly to provide a support surface for the powered accessories that are placed on the rack 24. The frame wire 58 may include raised lateral end portions 64, 66.

One or more partial length frame support wires 68 may extend partially between the lateral end portions 64, 66 of the frame 56. One or more of the upper surface wires 62 (e.g., wires 70) may terminate at the partial length frame support wires 68 thereby defining a void 72. The void 72, along with a forward portion 74 of the frame 56, may be utilized as a handle for moving the rack 24 within and/or outside of the heating cavity 16.

The third locating assembly 36 may be centrally disposed on the rear portion 38 of the rack 24. The third locating assembly 36 may be configured as one or more surface wire member extensions 78 that protrude above the frame 56 and/or rearwardly of the frame 56. When the rack 24 is slid rearward within the heating cavity 16 (i.e., into the heating cavity 16), the third locating assembly 36 may contact the rear wall 14 of the heating cavity 16 to prevent further insertion of the rack 24 into the heating cavity 16. Thus, the third locating assembly 36 may help locate the rack 24, and in some instances, the powered accessory 28 disposed on the rack 24, in a forward/rearward direction 46 within the heating cavity 16. Additionally, in various embodiments, the third locating assembly 36 may interact with the base pan 48, when the base pan 48 is disposed on the rack 24. For example, the base pan 48 may contact the third locating assembly 36 prior to sliding the rack 24 into the heating cavity 16. In such instances, the base pan 48 may be disposed in a position such that the cavity connector 20 and connection plug 30 may mate as the rack 24 is slid into the heating cavity 16.

Referring to FIGS. 3 and 6, the cavity connector 20 can include a housing 80 made of a thermally insulating material, such as a polymer, ceramic, silicone, or other material that can withstand high temperatures. The cavity connector 20 can include at least one electrical contact 82 within the housing 80. Likewise, the connection plug 30 includes housing 84 and at least one corresponding electrical tab 86 within the housing 84. The cavity connector 20 and the connection plug 30 can be configured as a male/female connection in which the cavity connector 20 and the connection plug 30 may be configured as the male portion. The at least one electrical contact 82 and the at least one electrical tab 86 can be made of any electrically conductive material, such as metal, that is configured in the form of pins or blades and female terminal sockets having a high temperature resistive material wrapped around the female terminal. The at least one electrical contact 82 and the at least one electrical tabs 86 can be capable of handling electrical current in the approximate range of approximately 5 amps to approximately 15 amps that can correspond to heating cavity 16 temperature ranges of approximately 0° F. to approximately 500° F., according to some embodiments. In various embodiments, at least one operable door is disposed forwardly of the electrical contacts 82.

According to the various embodiments, the electrical contact 82 of the cavity connector 20 can include a plurality of electrical contacts 82 that correspond to the electrical tabs 86 of the connecting plug 30. It is also contemplated that the electrical tabs 86 of a particular connecting plug 30 for a corresponding powered accessory 28 can include a predetermined pattern of electrical tabs 86. This predetermined pattern of electrical tabs 86 engage the electrical contacts 82 of the plurality of electrical contacts 82 of the cavity connector 20. In this manner, the predetermined pattern of electrical tabs 86 engages the electrical contacts 82 that correspond to the predetermined pattern. As such, the predetermined pattern can serve to identify a particular powered accessory 28 of a plurality of powered accessories 28 that are alternatively and selectively engaged with the cavity connector 20. This configuration can serve as an accessory detection mechanism disposed within the cavity connector 20.

Referring to FIGS. 7-12, the second locating assembly 34 may include a resilient component 88, such as a leaf spring, that is disposed between the sliding structure and one or more of the opposing sidewalls 12 of the heating cavity 16. The second locating assembly 34 may include a plate 90 that is removably, or permanently, coupled to the rack 24 and/or the sliding structure.

The resilient component 88 may be disposed within the plate 90, or integrally formed therewith. The resilient component 88 may be coupled to an outer surface 102 of the plate 90 on a first side 92 of the resilient component 88 through the usage of a fastener, such as a rivet. However, it is contemplated that the resilient component 88 may be attached through any other mechanical fastener, adhered thereto (e.g., welded), or otherwise coupled to the plate 90 in various embodiments. The resilient component 88 may be configured from a metallic material that may be formed from a planar sheet. Alternatively, any other material having resilient characteristics and is capable of standing temperatures of approximately 500° F. without deforming may utilized, according to some embodiments.

An opposing side 94 of the resilient component 88 may include an upper portion 96 having a hemmed edge and a lower portion 98 that may be disposed through a slot 100 defined by the plate 90 and along an inner surface 104 of the plate 90. The lower portion 98 may be configured as a guide tab 106. The guide tab 106 may slide along the plate 90 as the resilient component 88 is disposed in a wide range of positions. Accordingly, an end portion of the upper portion 96 may be disposed proximate the outer surface 102 of the plate 90 while the lower portion 98 is disposed proximate the inner surface 104 to hold the resilient component 88 within the plate 90.

In use, as a contact portion 108 of the resilient component 88 contacts the sidewall 12 of the cavity 16, a curvature of the resilient component 88 is altered. The first side 92 of the resilient component 88 maintains a constant position while the opposing side 94 of the resilient component 88 extends away from the first side 92. Accordingly, the resilient component 88 presses the sliding structure and/or the rack 24 away from the wall to maintain the rack 24 in a substantially constant lateral position. In various embodiments, the resilient component 88 may be of any geometry and/or form to contact the sidewall 12 and the plate 90 without departing from the scope of the present disclosure.

Referring to FIGS. 13A-14D, the powered accessory 28 may include the base pan 48. The first locating assembly 32 is disposed on the bottom portion 50 of the base pan 48 and may include one or more base structures 110. As illustrated in FIGS. 13A-14D, the base pan 48 may include a first base structure 112 that is configured to partially encompass at least one wire 114 of the rack 24. A second base structure 116 may have a flat top surface. The first and second base structures 112, 116 may each include a pair of first and second base structures 112, 116 that cooperate to maintain the base pan 48 in a level position when disposed on a planar surface, such as a countertop.

Figure 13A:
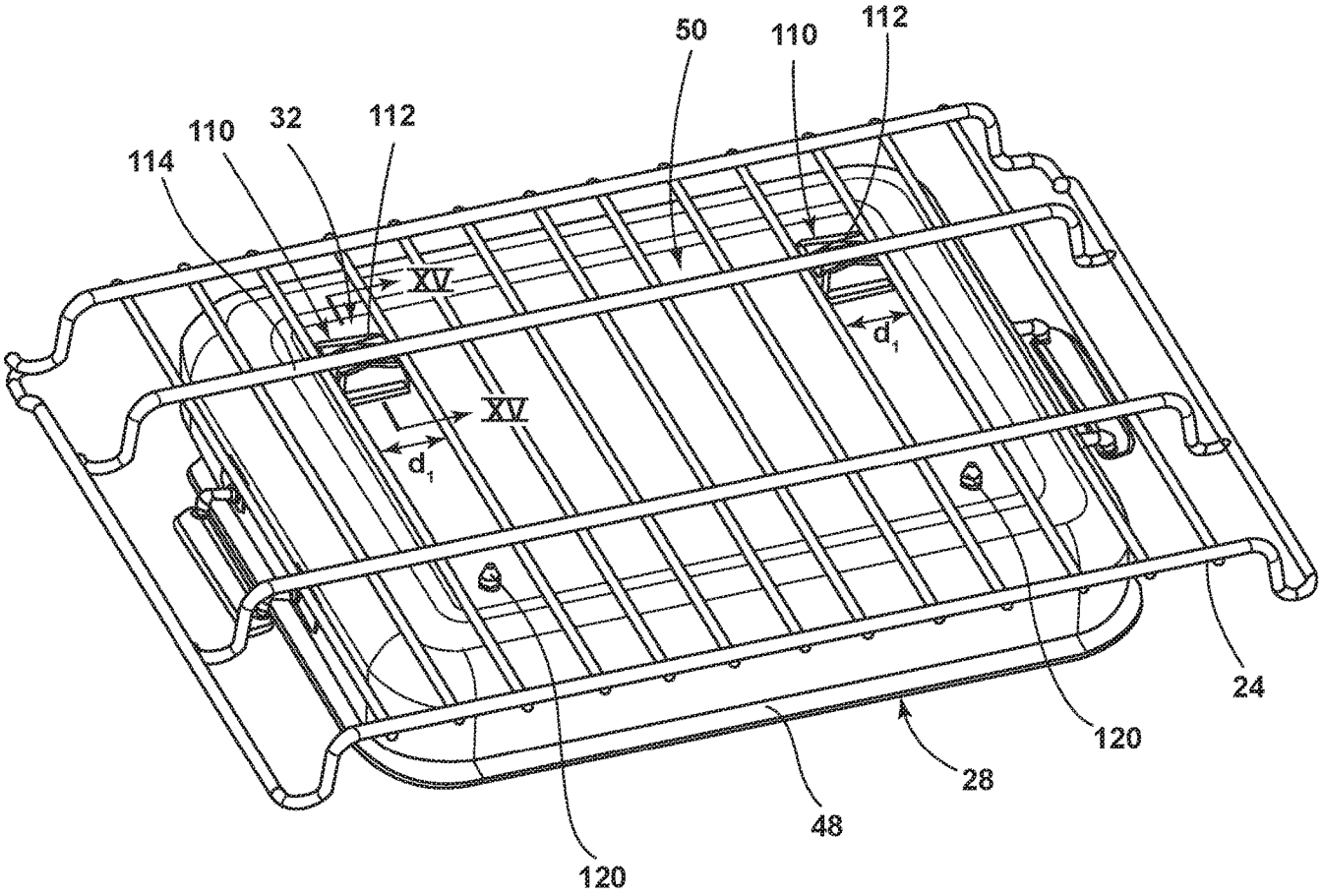
FIG. 13A is a bottom perspective view of a powered accessory base pan having first base structures thereon.
Figure 13B:
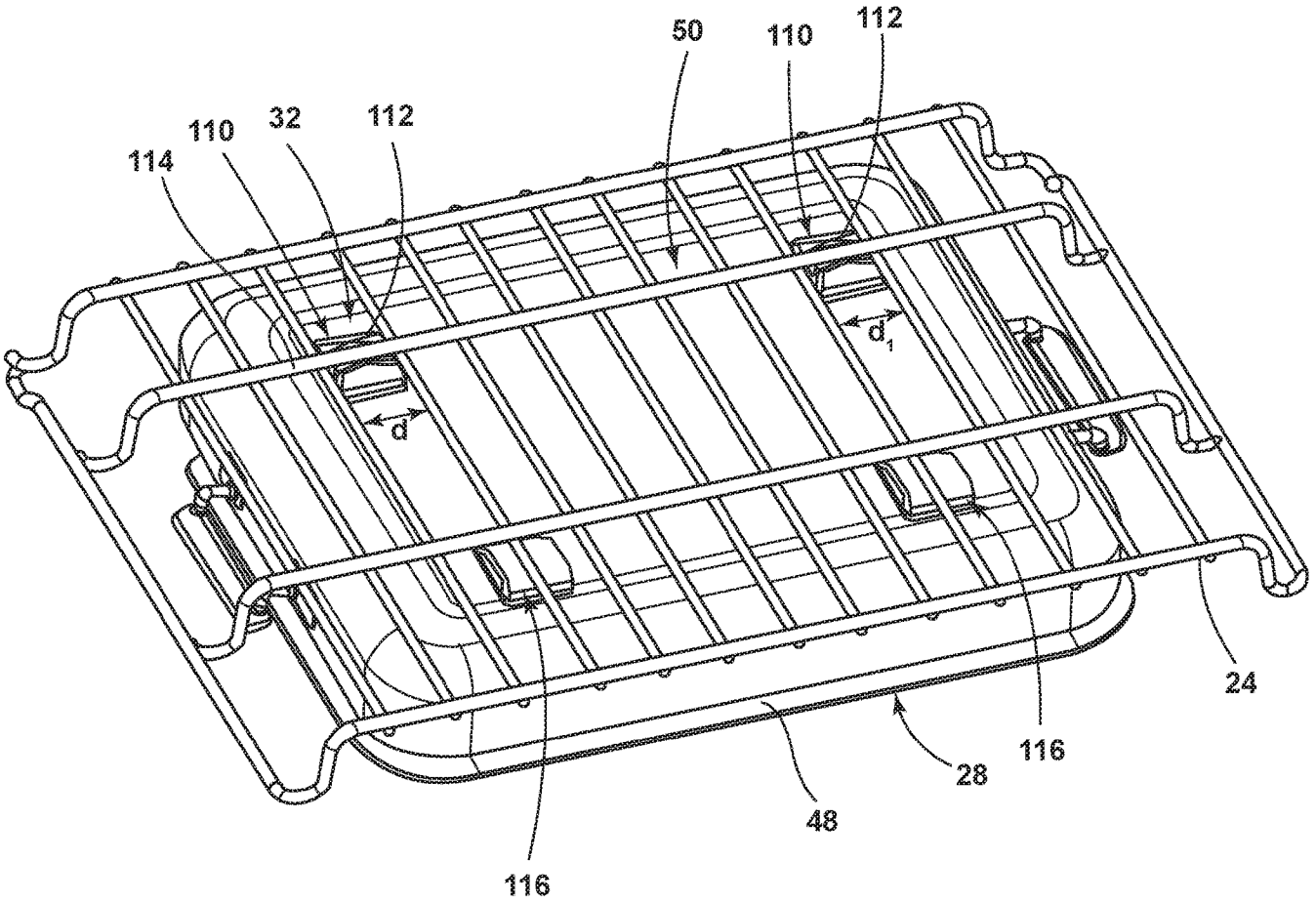
FIG. 13B is a bottom perspective view of a powered accessory base pan having first and second base structures thereon.
Figure 14B:
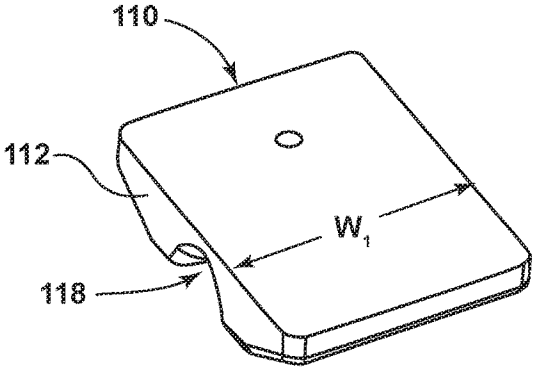
FIG. 14B is a top perspective view of the first base structure of FIG. 14A.
Figure 14D:
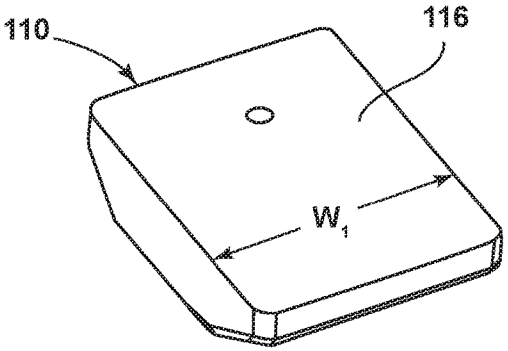
FIG. 14D is a top perspective view of the first base structure of FIG. 14B.
Figure 14A:
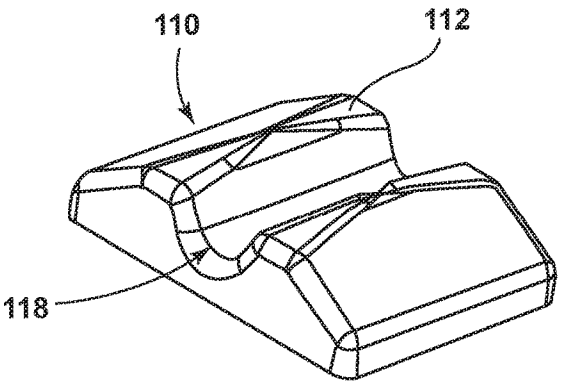
FIG. 14A is a bottom perspective view of the first base structure, according to one embodiment.
Figure 14C:
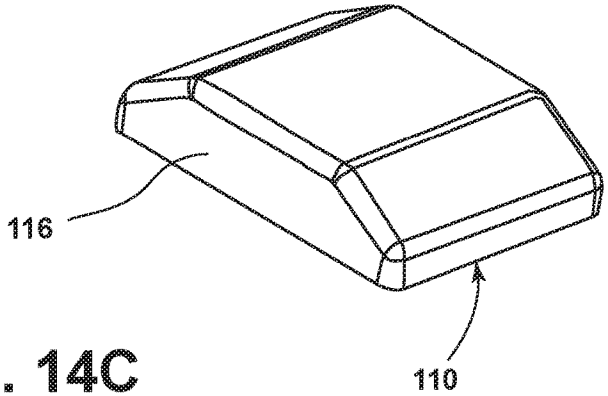
FIG. 14C is a bottom perspective view of the second base structure, according to one embodiment.

In order to consistently locate the base pan 48 on the rack 24, the first set of base structures may define a groove 118. The groove may be centrally located, or offset from a centerline of the first base structure 112. The groove 118 may be dimensioned to partially encompass one or more of the wires 114 of the rack 24. For example, as illustrated in FIG. 13A, the groove 118 is configured such that the first base structures 112 partially encompass one of the support wires 114. Accordingly, the base pan 48 may be disposed in a consistent forward/rearward direction 46 within the heating cavity 16. Each base structure may be configured to have a width $w_1$ that is less than a distance $d_1$ between two adjacently disposed upper surface wires 62. Accordingly, the base pan 48 may be disposed in a substantially consistent lateral position when the first and second base structures 112, 116 are disposed between the adjacently disposed upper surface wires 62. The term "consistent," as used herein, means that the base pan 48 may be placed in a substantially constant position when disposed over the same wire 114 in multiple instances. The base pan 48 may be laterally offset by a range of 10 millimeters and still be considered "consistently" disposed over the wire 114.

The first and second base structures 112, 116 may be coupled to the bottom portion 50 of the base pan 48 through the usage of a fastener, such as a pin 120. However, it is contemplated that the first and/or second base structures 112, 116 may be attached to the base pan 48 through any other mechanical fasteners, adhered thereto (e.g., welded), or otherwise coupled to the base pan 48 in various embodiments. In various embodiments, the first and/or second base structures 112, 116 may be integrally formed with the base pan 48.

Figure 15:
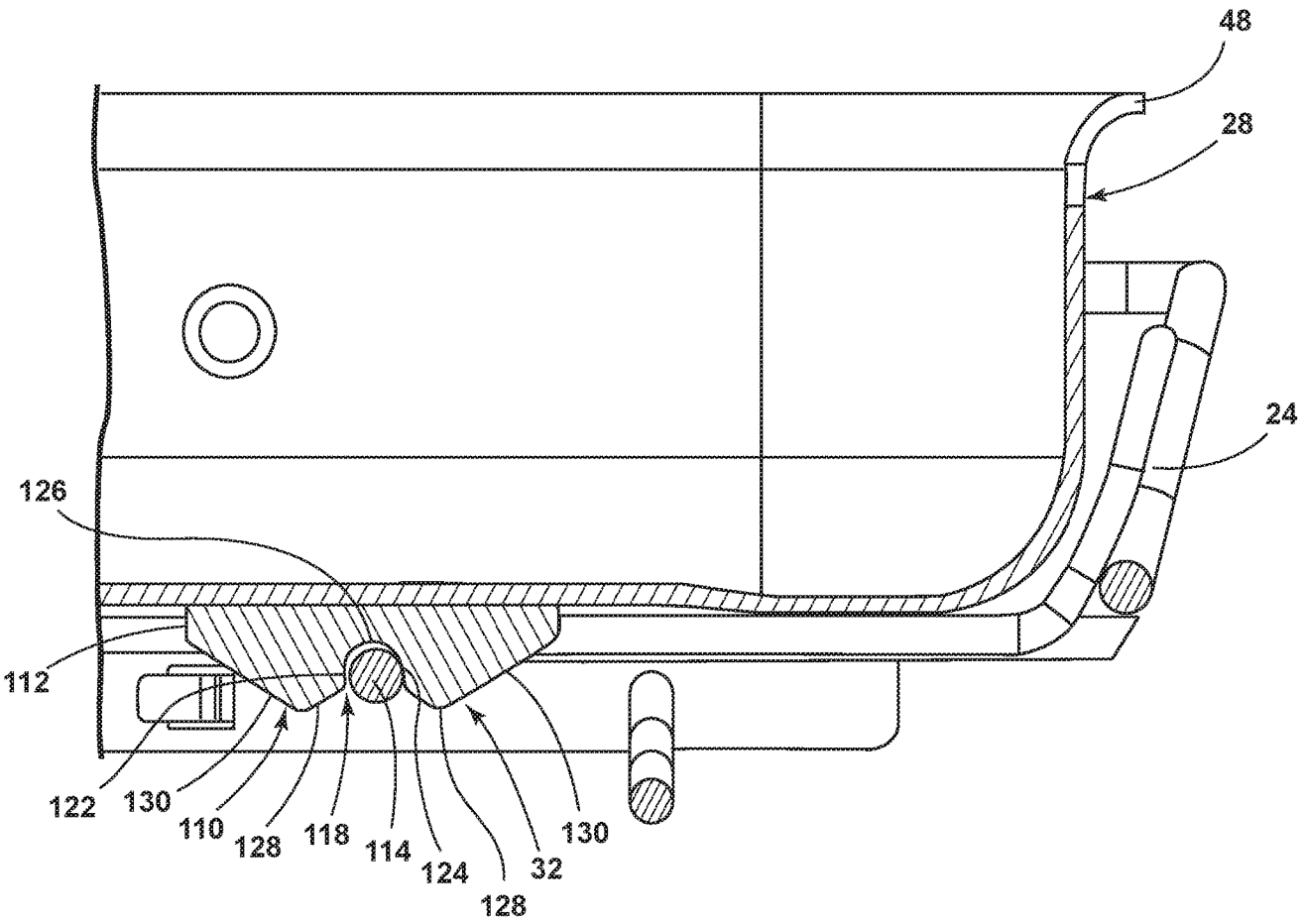
FIG. 15 is a cross-sectional view of the first base structure, according to one embodiment, taken along the line XV-XV of FIG. 13A.

Referring to FIG. 15, the first base structure 112 defines the centrally disposed groove 118 that is configured to partially encompass the wire 114. As illustrated, the wire 114 may be centrally disposed within the groove 118 such that two opposing edges 122, 124 of the groove 118 each may function as locking edges. According to various embodiments, the groove 118 has less than one (1) millimeter of clearance between each of the edges 122, 124 and the wire 114. A top portion 126 of the groove 118 may be disposed further from the wire 114 than the two opposing edges 122, 124.

Referring still to FIG. 15, a first chamfered surface 128 is disposed outwardly of both sides of the groove 118. The chamfered surface may assist in disposing the wire 114 within the groove 118. A second chamfered surface 130 may be disposed outwardly and offset from both of the first chamfered surfaces 128. The second chamfered surface 130 may be configured to move the groove 118 further from the groove 118 if the wire 114 is disposed under the second chamfered surface 130 to notify a user of the misalignment of the groove 118 to the wire 114. Moreover, the first chamfered surface 128 may help alleviate rearward misalignment of the groove 118 over the wire 114. The second chamfered surface 130 may alleviate forward misalignment of the groove 118 over the wire 114.

Figure 16:
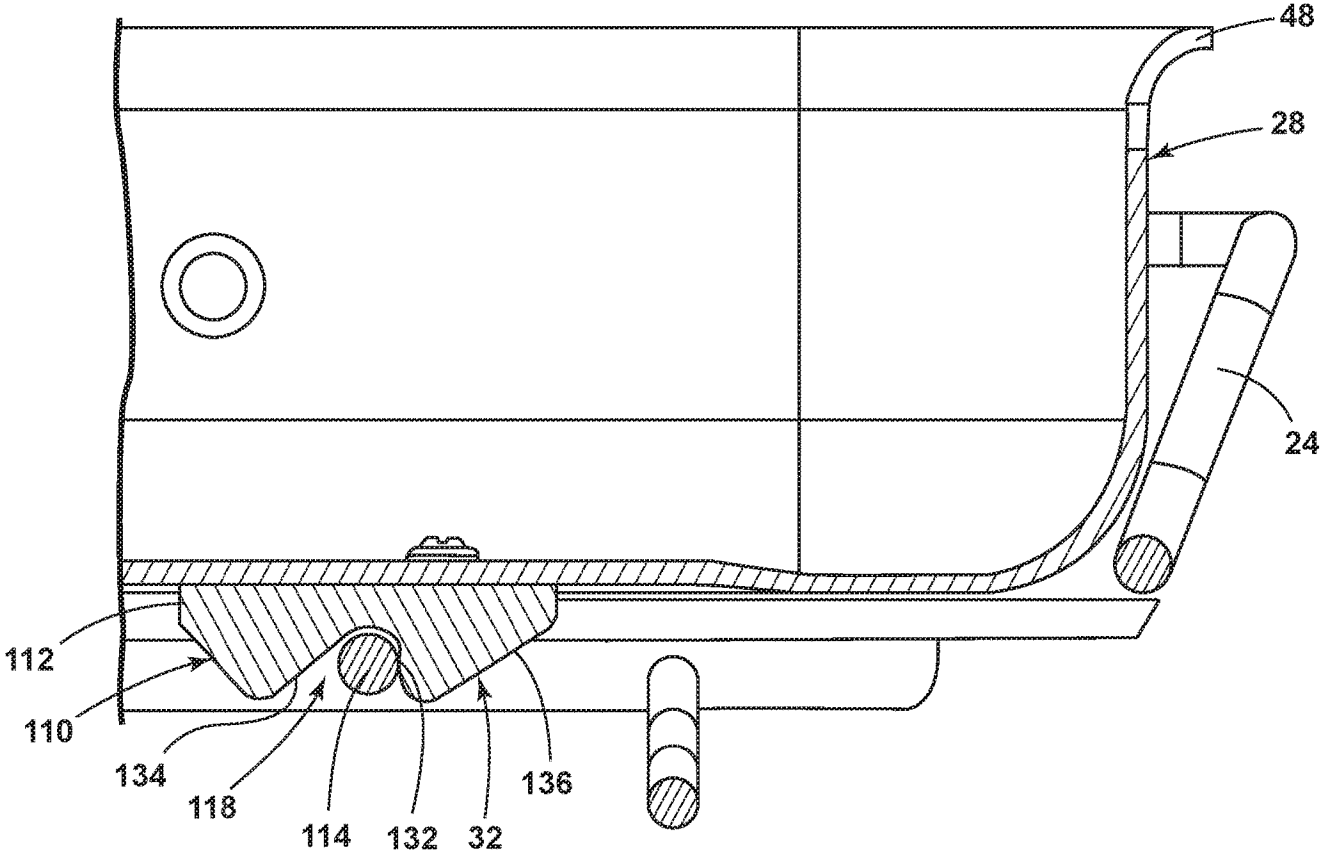
FIG. 16 is a cross-sectional view of the first base structure, according to an alternate embodiment, taken along the line XV-XV of FIG. 13A.

Referring to FIG. 16, the first base structure 112 may have a saw-tooth pattern wherein a first edge of the groove 118 may be the locking edge. First and second surfaces 134, 136 may define the groove 118 therebetween. The first and second surfaces 134, 136 may be substantially parallel. In some embodiments, the first surface 134 may alleviate forward misalignment of the groove 118 over the wire 114. The second surface 136 may alleviate rearward misalignment of the groove 118 over the wire 114.

Referring to FIGS. 17-22, various alignment assemblies that may be utilized as the first locating assembly 32 are exemplarily illustrated. Each assembly may be used in conjunction with any other alignment assembly provided herein, or independently thereof.

Figure 17:
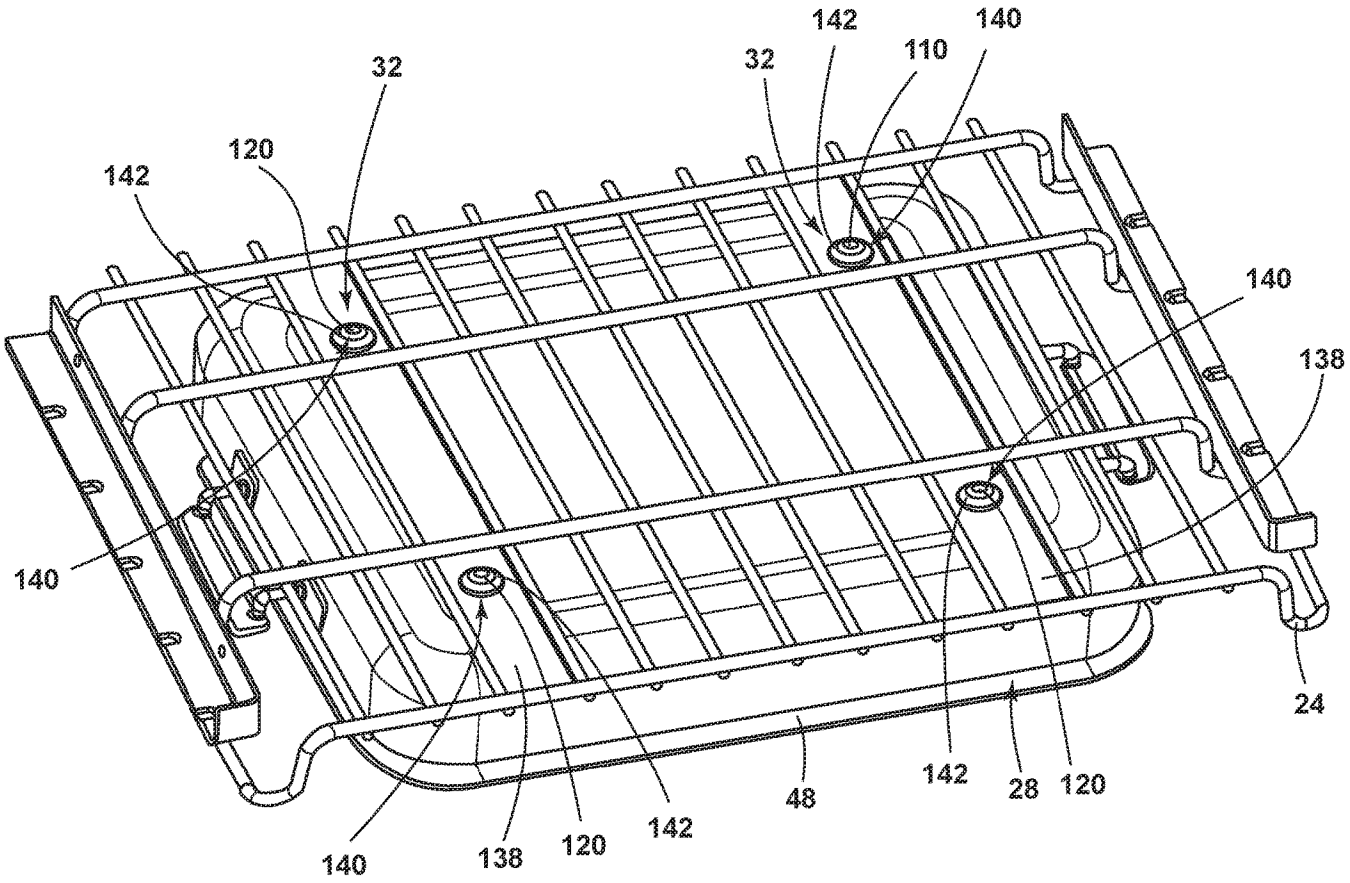
FIG. 17 is a bottom perspective view of the powered accessory having a pin that is removably coupled with an elongated member disposed on the rack, according to one embodiment.

Referring to FIG. 17, a pair of attachment members 138 is coupled to the rack 24. The attachment members 138 define one or more attachment holes 140. The attachment holes 140 may be encompassed by a tapered surface 142. The bottom portion 50 of the base pan 48 includes corresponding pins 120 and/or other engagement features thereon. To ensure proper alignment of the base pan 48 to the rack 24, the pins 120 are disposed within the attachment holes 140. It is contemplated that any number (one or more) attachment members 138 may be utilized for removably attaching the base pan 48 to the rack 24.

Figure 18:
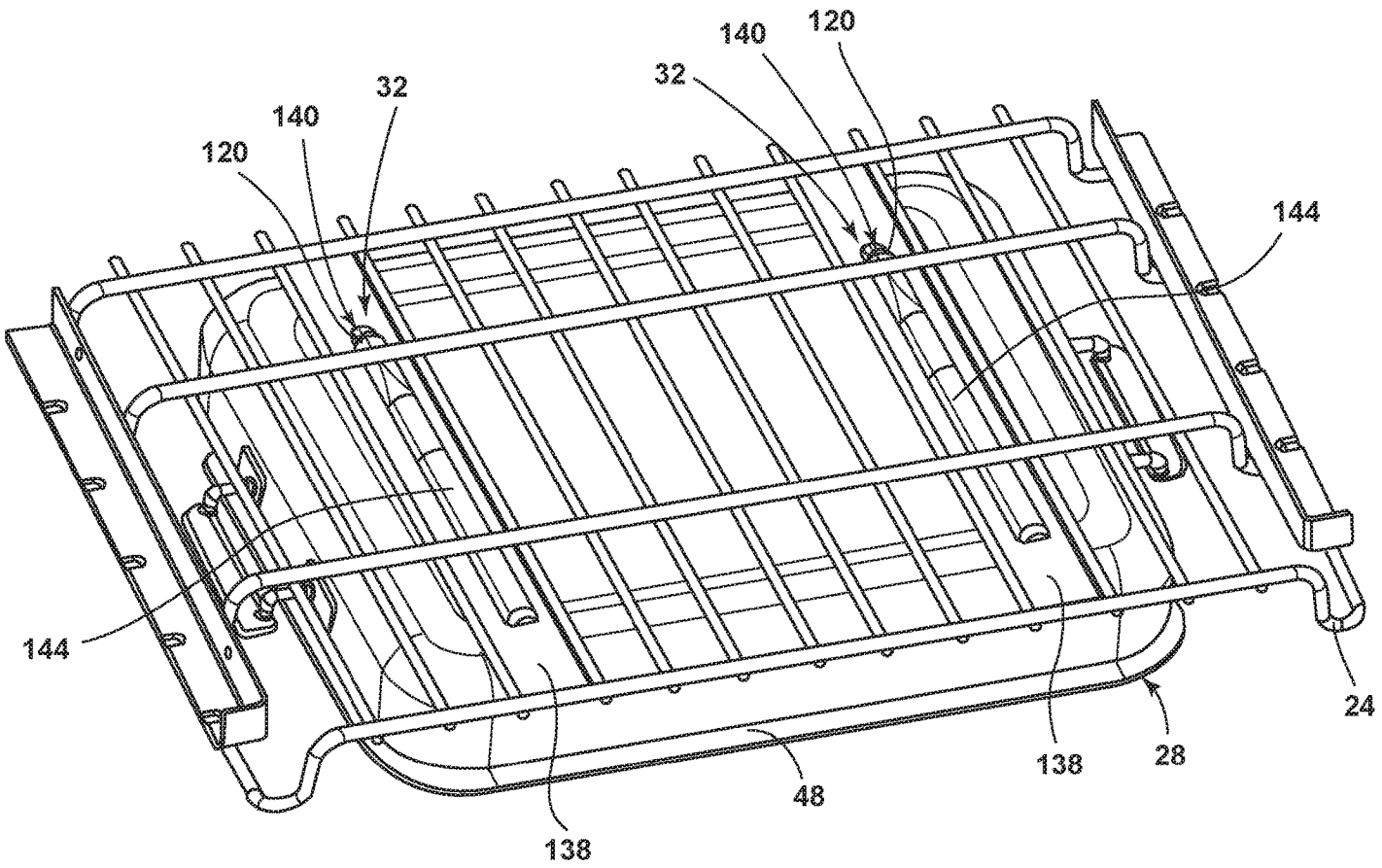
FIG. 18 is a bottom perspective view of the powered accessory having the pin that cooperates with an alignment groove that is defined by the elongated member disposed on the rack, according to one embodiment.

Referring to FIG. 18, the attachment member 138 includes an attachment hole 140 and an alignment groove 144. The powered accessory 28 may include the pins 120 on the bottom portion 50 thereof that may be disposed within the groove 144. The base pan 48 may then be slid in a forward/rearward direction 46 until the pins 120 are disposed within the attachment hole 140 that is defined by the attachment member 138.

Figure 19:
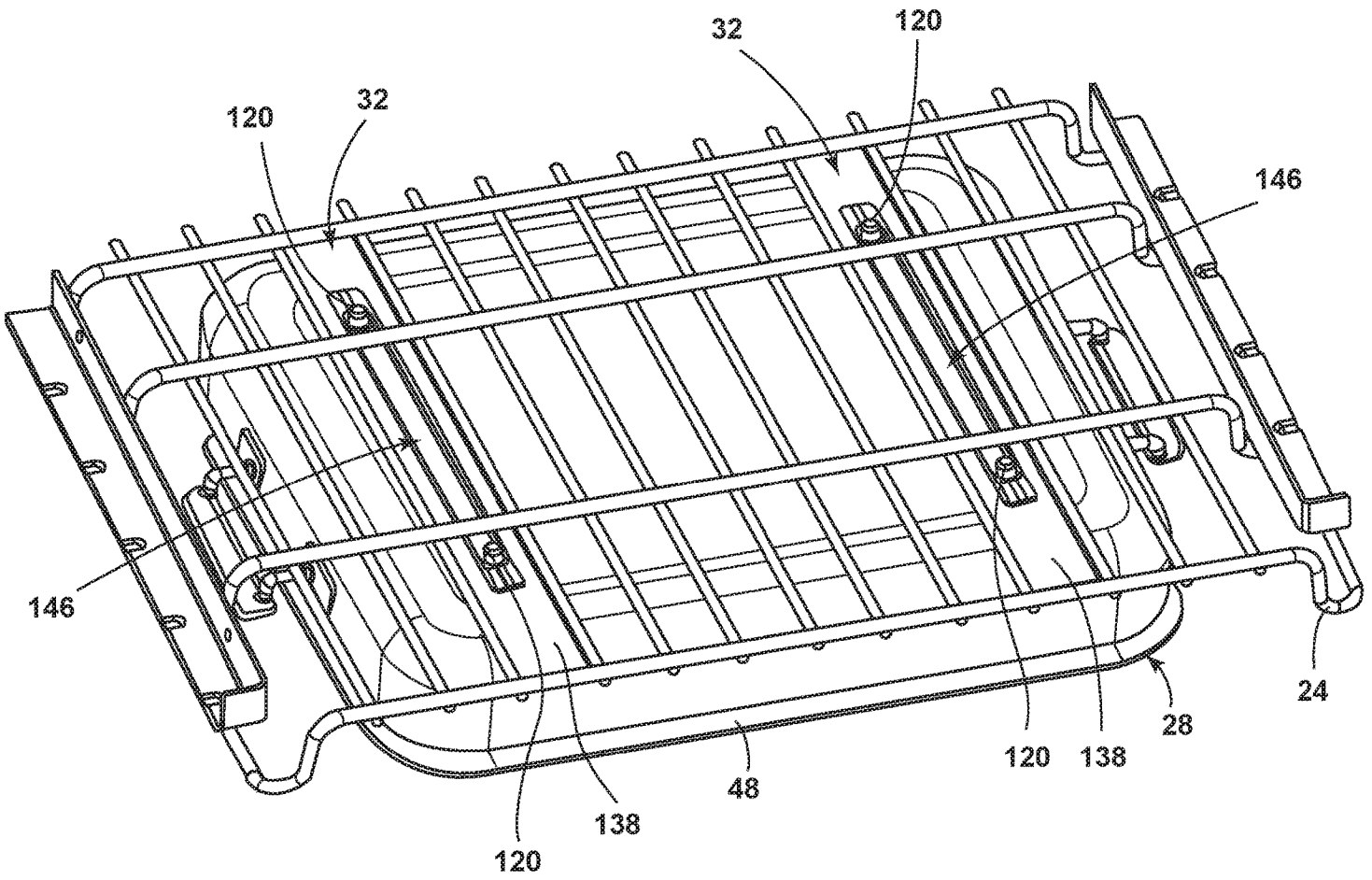
FIG. 19 is a bottom perspective view of the powered accessory having the pin that is insertable within an elongated slot that is defined by the elongated member disposed on the rack, according to one embodiment.

Referring to FIG. 19, the attachment member 138 may define an elongated slot 146. The elongated slot 146 may be partially, or fully, encompassed by a tapered surface 142 (FIG. 17). A plurality of pins 120 may be disposed on the bottom portion 50 of the powered accessory 28. A pin 120 may be configured to be disposed at each end portion of the elongated slot to maintain the base pan 48 in proper placement on the rack 24.

Figure 20:
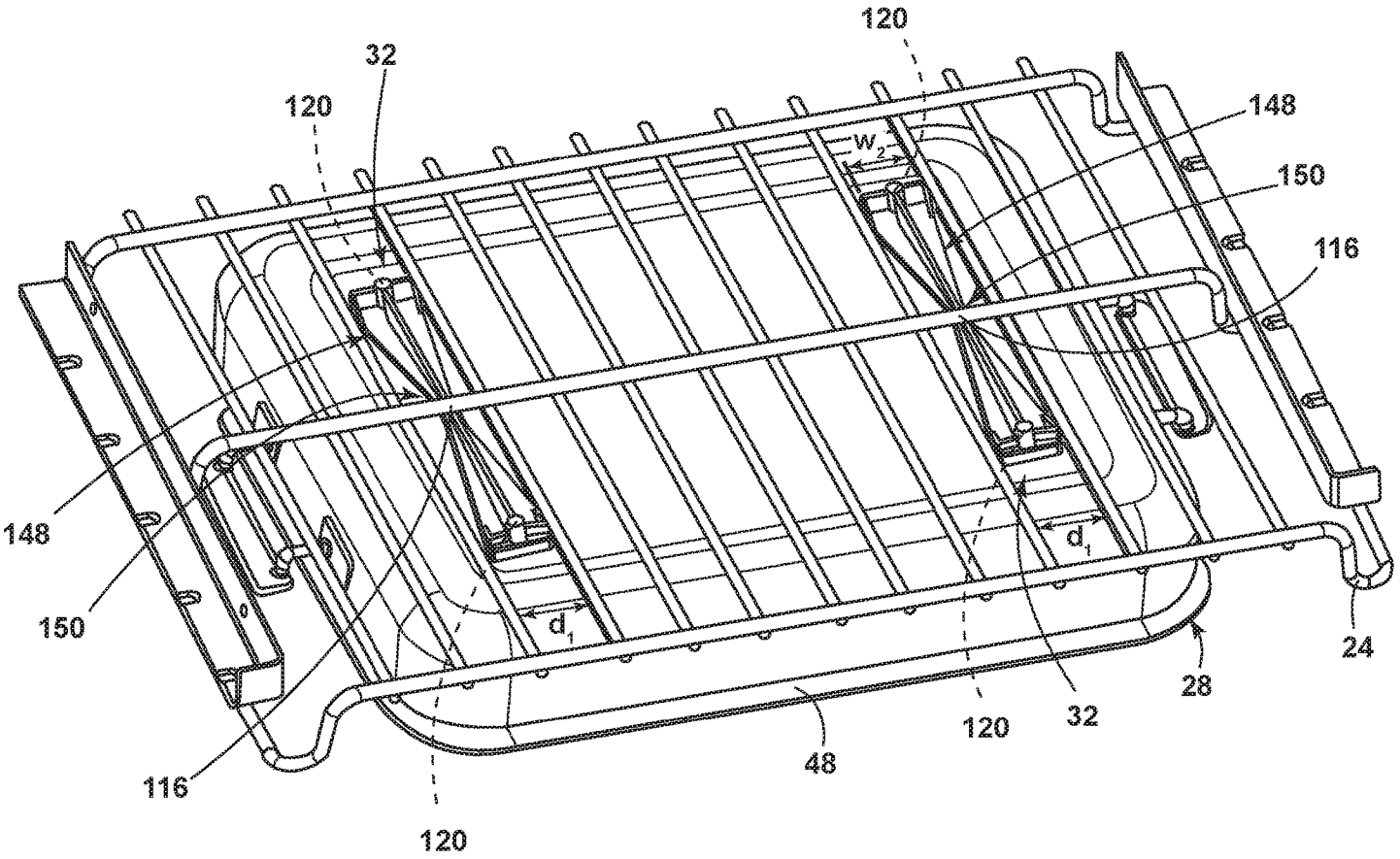
FIG. 20 is a bottom perspective view of the powered accessory having a pair of feet that cooperate with the rack, according to one embodiment.

Referring to FIG. 20, one or more feet 148 are coupled to the base pan 48. The one or more feet 148 define a groove 150 therein that may be disposed over laterally extending upper surface wires 62 of the rack 24. The one or more feet 148 may define a width $w_2$ that is less than the distance $d_1$ between two upper surface wires 62 of the rack 24. Accordingly, when the base pan 48 is placed in a desired position, the one or more feet 148 are disposed between the upper surface wires 62 to maintain the position of the base pan 48.

Figure 21:
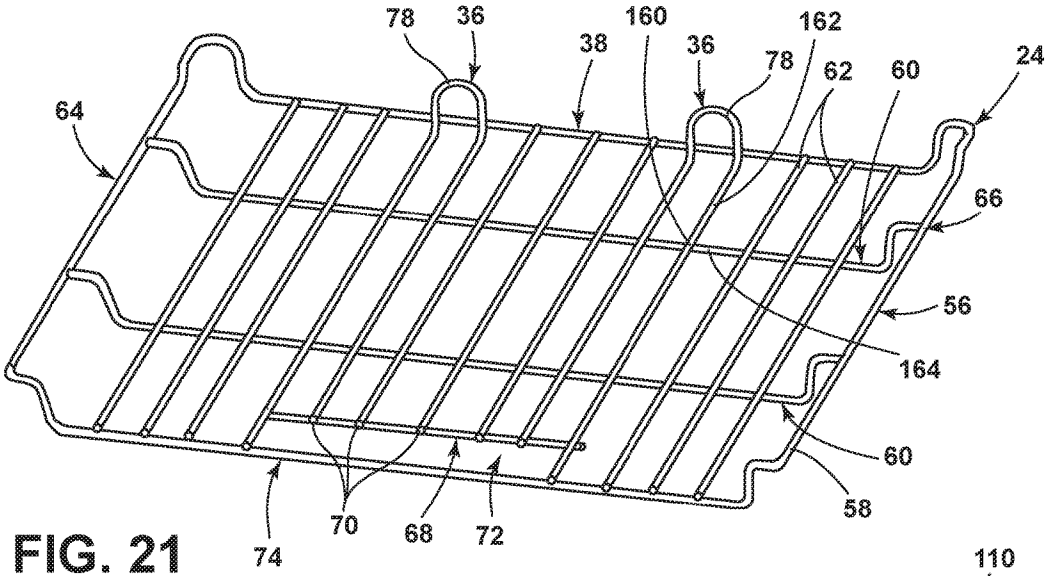
FIG. 21 is a top perspective view of a rack that is disposed within the heating cavity, according to one embodiment, having an intersection point of two wires.
Figure 22:
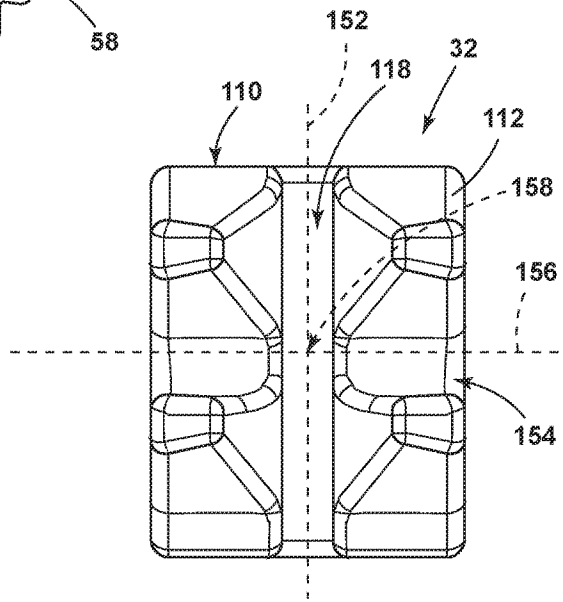
FIG. 22 is a bottom plan view of the first base structure, according to one embodiment, defining first and second intersecting grooves that are disposed over the two wires of FIG. 21.

Referring to FIGS. 21 and 22, the base pan 48 may include one or more first base structures 112 that define a first groove 118 that extends in a first direction 152 and a second, intersecting groove 154 that extends in a second, perpendicular direction 156 to the first groove 118. An intersection point 158 of the first and second grooves 118, 154 may be disposed on the rack 24 at a point 160 in which two wires 162, 164 of the rack 24 also perpendicularly intersect thereby holding the pan in a predefined location. The first base structures 112 extend below the two wires 162, 164 of the rack 24 in various embodiments.

A variety of advantages may be derived from the use of the present disclosure. For example, the locating assemblies provided herein allow for simple and repeatable locating of a powered accessory connection plug within a cavity connector. Moreover, the locating assemblies provided herein may be manufactured at low costs.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited, to physically mateable and/or physically interacting components and/or wirelessly interactable and/or wirelessly interacting components and/or logically interacting and/or logically interactable components.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A cooking appliance comprising:

a pair of opposing sidewalls and a rear wall defining a heating cavity;

a heat source in thermal communication with the heating cavity;

a cavity connector disposed within an interior surface of the heating cavity, the cavity connector being in communication with the heating cavity;

a rack coupled with a sliding structure, the sliding structure disposed at the pair of sidewalls;

a powered accessory having a connecting plug, wherein the powered accessory is engageable with the rack and the connecting plug is configured to be in selective communication with the cavity connector;

a first locating assembly configured to locate and engage the powered accessory with the rack;

a second locating assembly disposed between the sliding structure and the opposing sidewalls;

wherein the first locating assembly is configured as a base structure that is coupled to the accessory and includes a centrally disposed groove that is engageable with one of a plurality of wires that are coupled to an outer frame, and wherein the second locating assembly is configured as a resilient metallic component that is coupled to a member on a first end portion and through a slot defined by the member on an opposing, second end portion.

2. The cooking appliance of claim 1, wherein the cavity connector is disposed in the rear wall.

3. The cooking appliance of claim 1, wherein the cavity connector includes a single connecting port defined within the interior surface of the heating cavity.

4. The cooking appliance of claim 1, wherein a third locating assembly is configured as a structure that extends from the rack and contacts the rear wall of the heating cavity to prevent further insertion of the rack into the cavity.

5. The cooking appliance of claim 4, wherein the third locating assembly is centrally disposed within a rear portion of the rack and protrudes above the outer frame and rearwardly of the outer frame.

6. The cooking appliance of claim 1, wherein the powered accessory includes a base pan and a resistive heating element, wherein when the base pan is in selective engagement with the rack and the resistive heating element is in selective communication with the cavity connector.

7. A cooking appliance comprising:

a pair of sidewalls and a rear wall defining a heating cavity;

a heat source in thermal communication with the heating cavity;

a cavity connector disposed within an interior surface of the heating cavity, the cavity connector being in communication with the heating cavity;

a rack defined by a plurality of wires coupled to a frame;

a powered accessory having a connecting plug, wherein the powered accessory is engageable with the rack and the connecting plug is configured to be in selective communication with the cavity connector; and a first locating assembly configured to locate the powered accessory on the rack wherein the first locating assembly includes a first base structure disposed on a bottom portion of a base pan, the first base structure defining a groove therein and a second base structure disposed on the bottom portion of the base pan separated from the first base structure and extending between two adjacent wires of the rack, and wherein the first locating assembly is configured as a pair of pins disposed on a bottom portion of the base pan that is disposed within apertures defined by an attachment member on the rack.

8. The cooking appliance of claim 7, wherein a control unit of the cooking appliance is in communication with the cavity connector and a user interface of the cooking appliance and the control unit places the user interface of the cooking appliance in signal communication with the powered accessory.

9. The cooking appliance of claim 7, wherein the groove defined by the first base structure partially encompasses the wire of the rack and includes at least one locking edge.

10. The cooking appliance of claim 9, wherein the first base structure includes a first chamfered surface disposed outwardly of the groove.

* * * * *